US010497554B2

(12) United States Patent
Asakawa

(10) Patent No.: US 10,497,554 B2
(45) Date of Patent: Dec. 3, 2019

(54) MASS SPECTROMETRY APPARATUS AND MASS SPECTROMETRY METHOD

(71) Applicant: TOSHIBA MEMORY CORPORATION, Minato-ku (JP)

(72) Inventor: Jun Asakawa, Yokkaichi (JP)

(73) Assignee: TOSHIBA MEMORY CORPORATION, Minato-ku (JP)

( * ) Notice: Subject to any disclaimer, the term of this patent is extended or adjusted under 35 U.S.C. 154(b) by 0 days.

(21) Appl. No.: 15/919,485

(22) Filed: Mar. 13, 2018

(65) Prior Publication Data

US 2019/0088461 A1 Mar. 21, 2019

(30) Foreign Application Priority Data

Sep. 19, 2017 (JP) ..... 2017-179419

(51) Int. Cl.

| | |
|---|---|
| ***H01J 49/00*** | (2006.01) |
| ***H01J 49/40*** | (2006.01) |
| ***H01J 49/04*** | (2006.01) |
| ***H01J 49/16*** | (2006.01) |

(52) U.S. Cl.

CPC ..... *H01J 49/405* (2013.01); *H01J 49/0031* (2013.01); *H01J 49/0054* (2013.01); *H01J 49/0463* (2013.01); *H01J 49/162* (2013.01)

(58) Field of Classification Search

CPC ... H01J 49/405; H01J 49/0031; H01J 49/0054

USPC ..... 250/281, 282, 287

See application file for complete search history.

(56) References Cited

U.S. PATENT DOCUMENTS

| | | | | |
|---|---|---|---|---|
| 4,670,651 A * | 6/1987 | Meier | H01J 49/142 250/281 |
| 9,299,552 B2 * | 3/2016 | Yorisaki | H01J 49/0409 |
| 2017/0076930 A1 * | 3/2017 | Akutsu | H01J 49/162 |

FOREIGN PATENT DOCUMENTS

| | | |
|---|---|---|
| JP | 07-280752 | 10/1995 |
| JP | 2015-176848 | 10/2015 |
| JP | 3 139 400 A1 | 3/2017 |
| JP | 2017-049216 | 3/2017 |
| JP | 2017-054737 | 3/2017 |
| JP | 2017-054784 | 3/2017 |

* cited by examiner

*Primary Examiner* — Michael Maskell
(74) *Attorney, Agent, or Firm* — Oblon, McClelland, Maier & Neustadt, L.L.P.

(57) ABSTRACT

According to an embodiment, a mass spectrometry apparatus includes a beam irradiator, a laser irradiator, a mass spectrometer and a controller. The beam irradiator irradiates a sample with an ion beam. The laser irradiator irradiates a space above the sample with laser light. The mass spectrometer performs mass spectrometry of an ionized particle. The controller controls at least one of the laser irradiator and the mass spectrometer on the basis of an analysis result of the mass spectrometer.

10 Claims, 8 Drawing Sheets

MASS SPECTROMETRY APPARATUS AND MASS SPECTROMETRY METHOD

CROSS-REFERENCE TO RELATED APPLICATIONS

This application is based upon and claims the benefit of priority from Japanese Patent Application No. 2017-179419, filed on Sep. 19, 2017; the entire contents of which are incorporated herein by reference.

FIELD

Embodiments of the present invention relate to a mass spectrometry apparatus and a mass spectrometry method.

BACKGROUND

In the progress of highly integrated, fine semiconductor devices, highly accurate mass spectrometry for a very small region has been requested. Thereupon, laser SNMS (Sputtered Neutral Mass Spectrometry) is attracting attention. In the laser SNMS, particles emitted from the surface of a sample under irradiation with an ion beam are irradiated with laser light. Thereby, the particles are ionized, followed by mass spectrometry of the resulting ion particles.

In the case of mass spectrometry by the laser SNMS, detection accuracy of an ion particle is affected by measurement conditions such as irradiation conditions for the laser light and mass spectrometry conditions for the ion particle. However, adjustment of the measurement conditions is complex and should needs experienced skills, which takes much time.

DETAILED DESCRIPTION

Embodiments will now be explained with reference to the accompanying drawings. The present invention is not limited to the embodiments.

First Embodiment

Figure 1:
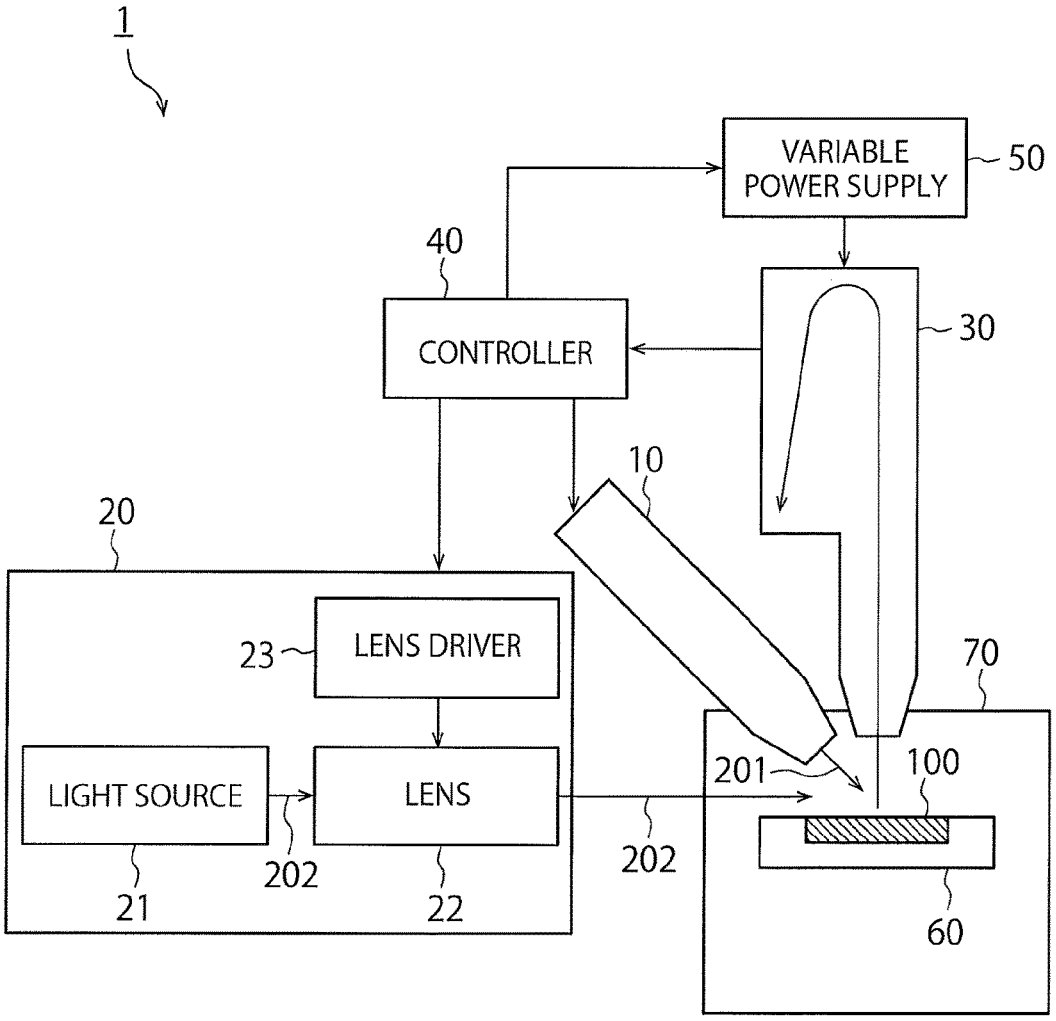
FIG. 1 is a diagram schematically showing a configuration of a mass spectrometry apparatus according to a first embodiment.

FIG. 1 is a diagram schematically showing a configuration of a mass spectrometry apparatus according to a first embodiment. A mass spectrometry apparatus 1 according to the present embodiment includes a beam irradiator 10, a laser irradiator 20, a mass spectrometer 30, a controller 40, a variable power supply 50, a sample stage 60 and a chamber 70.

The beam irradiator 10 irradiates a sample 100 with an ion beam 201. The ion beam 201 is a focused ion beam (FIB), for example, containing gallium ions. The sample 100 is disposed on the sample stage 60. When the sample 100 is irradiated with the ion beam 201 in the chamber 70 in a vacuum state, the sample 100 is caused to sputter, and particles are emitted from the surface thereof.

The laser irradiator 20 has a light source 21, a lens 22 and a lens driver 23. The light source 21 emits laser light 202. The laser light 202 is condensed by the lens 22, and with the same, a space above the sample 100 is irradiated. The particles emitted from the sample 100 are ionized by the laser light 202.

The lens driver 23 adjusts a position of the lens 22 on the basis of control of the controller 40. By adjusting the position of the lens 22, an optical position of the laser light 202 can be adjusted. Herein, an adjustment of the optical position of the laser light 202 is described with reference to FIG. 2A and FIG. 2B.

Figure 2A:
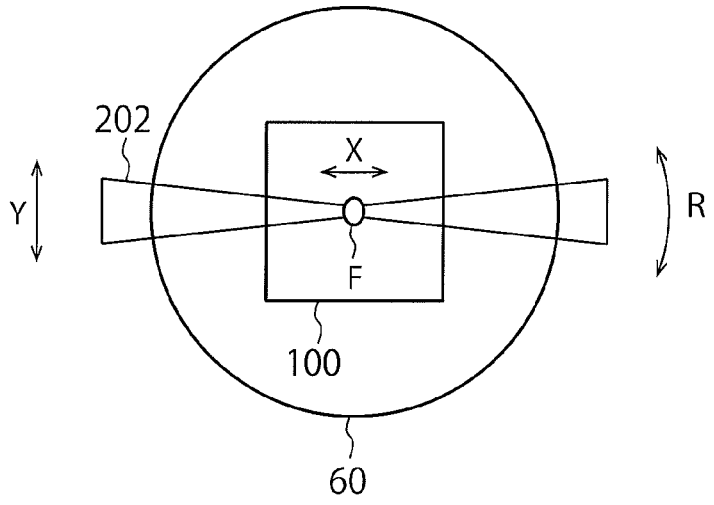
FIG. 2A is a plan view showing an irradiation state of laser light.
Figure 2B:
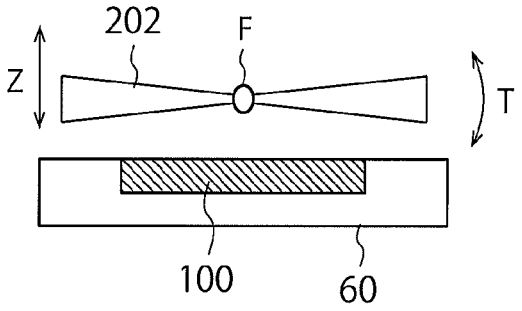
FIG. 2B is a cross-sectional view showing an irradiation state of laser light.

FIG. 2A is a plan view showing an irradiation state of the laser light 202. FIG. 2B is a cross-sectional view showing the irradiation state of the laser light 202.

As shown in FIG. 2A, the optical position of the laser light 202 can be adjusted in a transverse direction Y crossing the optical axis of the laser light 202 and in a circumferential direction R with a focus F of the laser light 202 taken as its center. Moreover, a position of the focus F can be adjusted in a direction X perpendicular to the transverse direction Y. Furthermore, as shown in FIG. 2B, the optical position of the laser light 202 can be adjusted in a height direction Z relative to the sample 100 and in a tilt direction T relative to the sample 100.

Ion particles ionized by receiving the laser light 202 are subject to mass spectrometry by the mass spectrometer 30. Herein, the mass spectrometer 30 is described with reference to FIG. 3.

Figure 3:
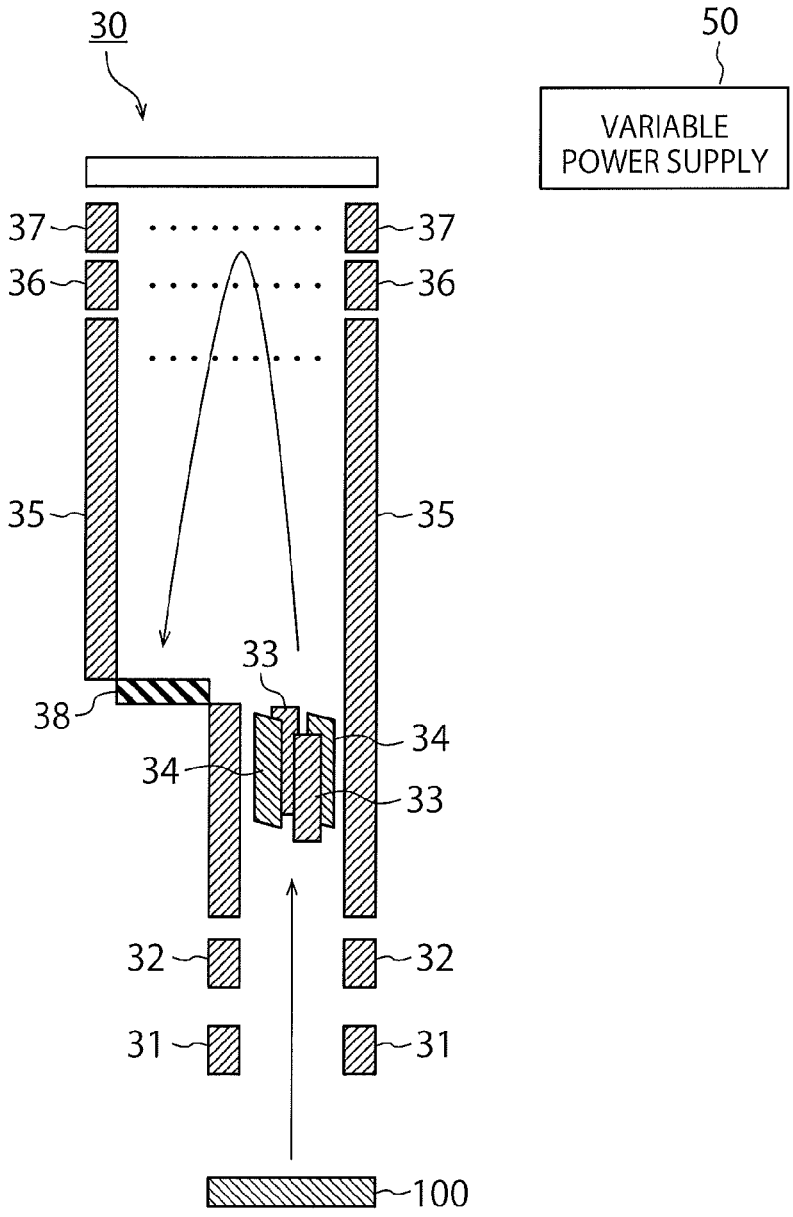
FIG. 3 is a diagram schematically showing an internal configuration of a mass spectrometer.

FIG. 3 is a diagram schematically showing an internal configuration of the mass spectrometer 30. The mass spectrometer 30 shown in FIG. 3 is of a reflectron type in which ion particles are allowed to fly and the direction of flight is reversed in the middle thereof. Specifically, the mass spectrometer 30 includes an extractor electrode 31, a lens electrode 32, a first deflector electrode 33, a second deflector electrode 34, a drift electrode 35, an R-top electrode 36, an R-bottom electrode 37 and a micro channel plate (MCP) 38.

The extractor electrode 31 to the R-bottom electrode 37 are arranged along the trajectory of ion particles. Moreover, these electrodes are connected to the variable power supply 50. The variable power supply 50 can adjust voltages applied to the electrodes on the basis of control of the controller 40.

Upon application of a voltage to the extractor electrode 31, an electric field is formed between the sample 100 and the mass spectrometer 30. This electric field extracts ion particles into the mass spectrometer 30. The extracted ion particles are focused by applying a voltage to the lens electrode 32.

Moreover, a trajectory adjustment can be performed such that the ion particles can reach the MCP 38, by adjusting voltages applied to the first deflector electrode 33, the second deflector electrode 34 and the drift electrode 35 by the variable power supply 50. Furthermore, deviation of the ion particles can be suppressed by adjusting voltages applied to the R-top electrode 36 and the R-bottom electrode 37 by the variable power supply 50.

The MCP 38 detects the ion particles. Thereby, a time of flight "TOF" of an ion particle can be measured. The mass of the ion particle can be calculated from the time of flight "TOF". Accordingly, the mass spectrometer 30 can identify a material (elements) contained in the sample 100 by detecting the masses of the ion particles on the basis of the times of flight.

Figure 4:
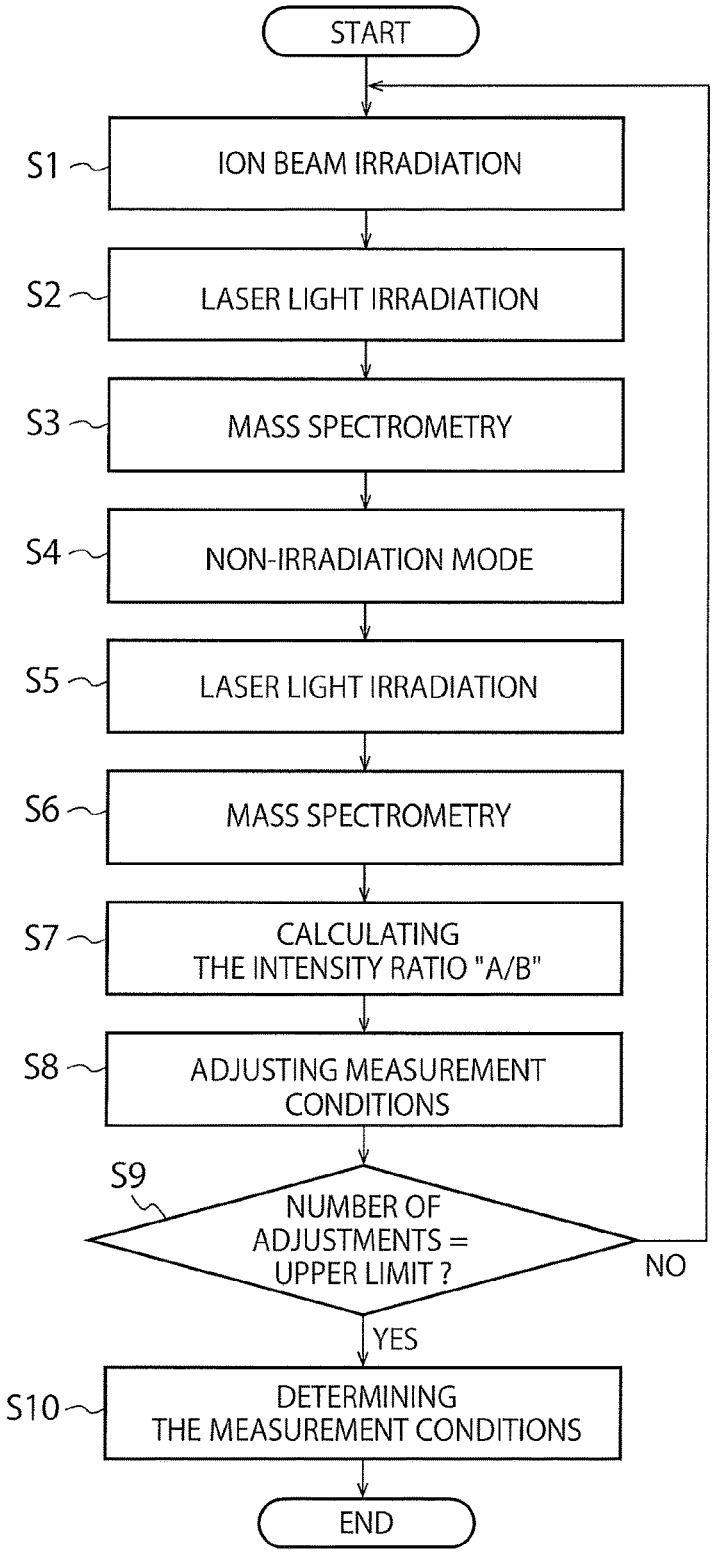
FIG. 4 is a flowchart showing a mass spectrometry method according to the first embodiment.

Hereafter, a mass spectrometry method according to the present embodiment is described. FIG. 4 is a flowchart showing the mass spectrometry method according to the present embodiment.

First, the beam irradiator 10 is brought into an irradiation mode on the basis of control of the controller 40 to irradiate the sample 100 with the ion beam 201 (step S1). Subsequently, the laser irradiator 20 irradiates the space above the sample 100 with the laser light 202 (step S2).

Next, the mass spectrometer 30 performs mass spectrometry of ion particles (step S3). The analysis result of the mass spectrometer 30 is output to the controller 40. After that, the beam irradiator 10 is switched from the irradiation mode into a non-irradiation mode on the basis of control of the controller 40 (step S4). In the non-irradiation mode, irradiation of the ion beam 201 is not performed.

Subsequently, similarly to step S2, the laser irradiator 20 performs irradiation with the laser light 202 (step S5). Next, similarly to step S3, the mass spectrometer 30 performs mass spectrometry of ion particles (step S6). Herein, analysis results of the mass spectrometer 30 in the irradiation mode and in the non-irradiation mode are exemplarily described with reference to FIG. 5A and FIG. 5B.

Figure 5A:
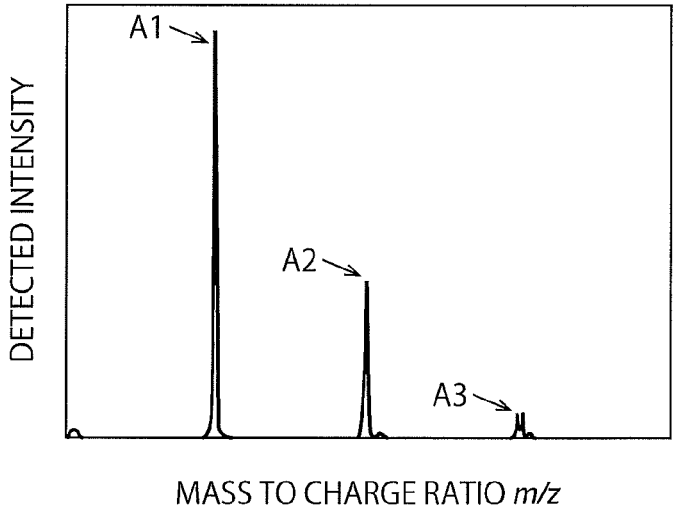
FIG. 5A exemplarily shows a mass spectrum in an irradiation mode.
Figure 5B:
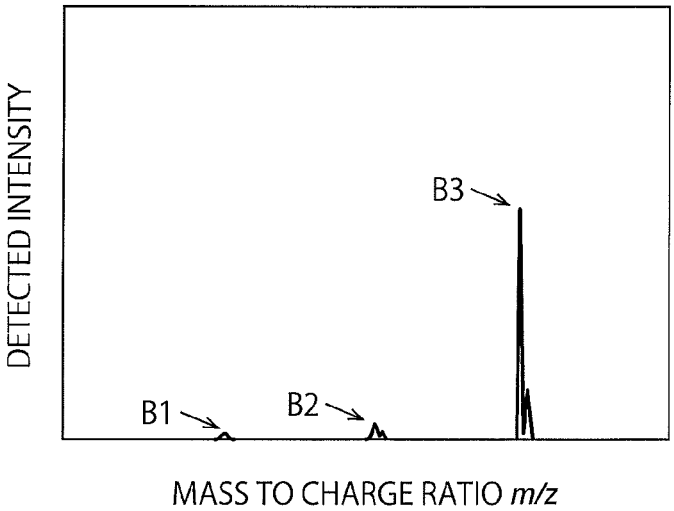
FIG. 5B exemplarily shows a mass spectrum in a non-irradiation mode.

FIG. 5A exemplarily shows a mass spectrum in the irradiation mode. FIG. 5B exemplarily shows a mass spectrum in the non-irradiation mode. In FIG. 5A and FIG. 5B, the horizontal axis designates a mass to charge ratio "m/z" between a mass "m" and a charge number "z", and the vertical axis designates a detected intensity of an ion particle. Notably, the scales of the horizontal axes in FIG. 5A and FIG. 5B are the same as each other. Meanwhile, the scale of the vertical axis in FIG. 5A is larger than the scale of the vertical axis in FIG. 5B.

Upon irradiation of the laser irradiator 20 with the laser light 202 in step S2, not only particles emitted from the surface of the sample 100 but also gas particles existing in an extremely small amount in the chamber 70 are ionized. The ionized gas particles are taken into the mass spectrometer 30. Therefore, the mass spectrum shown in FIG. 5A problematically includes also the intensities due to the ionized gas particle.

Hence, in the present embodiment, only the ionized gas particles are taken into the mass spectrometer 30 in step S5 by irradiation with the laser light 202 without irradiation with the ion beam 201. As a result, the mass spectrum shown in FIG. 5B shows only the intensities due to the ionized gas particles.

Subsequently to step S6, the controller 40 calculates an intensity ratio "A/B" between a detected intensity "A" of an ion particle in the irradiation mode and a detected intensity "B" of the ion particle in the non-irradiation mode (step S7). For example, when the sample 100 contains carbon (C), nitrogen (N) and a hydroxyl group (OH), in the mass spectrum shown in FIG. 5A, three peak values "A1", "A2" and "A3" are detected. Accordingly, the controller 40 specifies peak values "B1" to "B3" respectively corresponding to the peak values "A1" to "A3" from the mass spectrum shown in FIG. 5B to calculate intensity ratios "A1/B1" to "A3/B3" between the peak values.

For example, the intensity ratio "A1/B1" corresponds to carbon (C), the intensity ratio "A2/B2" corresponds to hydroxyl group (OH), the intensity ratio "A3/B3" corresponds to nitrogen (N).

After calculating the intensity ratio "A/B", the controller 40 adjusts measurement conditions for the ion particles by controlling at least one of the lens driver 23 and the variable power supply 50 (step S8).

In step S8, when the position of the lens 22 is changed by a control operation of the controller 40, irradiation conditions for the laser light 202 are changed. Moreover, also when a delay time from an irradiation start time of the ion beam 201 to an irradiation start time of the laser light 202 is changed, the irradiation conditions for the laser light 202 are changed. On the other hand, when the applied voltages to the electrodes provided in the mass spectrometer 30 are changed by a control operation of the controller 40, electric field intensities on the trajectory of the ion particles are changed.

Notably, in step S8, in the case of positional adjustments of the lens 22, it is not needed to change all the parameters shown in FIG. 2A and FIG. 2B. For example, when positional adjustments in the transverse direction Y, in the height direction Z and of the focus F sensitively respond to the detection of the ion particles, these positional adjustments may be predominantly performed.

Likewise, also when the applied voltages to the electrode provided in the mass spectrometer 30 are adjusted, it is not needed to adjust the applied voltages for all the electrodes. For example, when the applied voltages to the lens electrode 32, the first deflector electrode 33 and the second deflector electrode 34 sensitively respond to the detection of the ion particles, these voltage adjustments may be predominantly performed. As above, setting priorities for the control operations of the controller 40 can shorten a measurement time.

The aforementioned operations in step S1 to step S8 are performed until the number of adjustments of the measurement conditions reaches a preset upper limit, in order to enhance a detection sensitivity for the ion particles (step S9). By limiting the number of the control operations of the controller 40 as above, a measurement time can be suppressed.

When the number of adjustments reaches the upper limit, the controller 40 determines the measurement conditions on the basis of the intensity ratios "A/B" calculated every time the adjustments are performed (step S10). Herein, a determination method of the measurement conditions is described with reference to FIG. 6.

Figure 6:
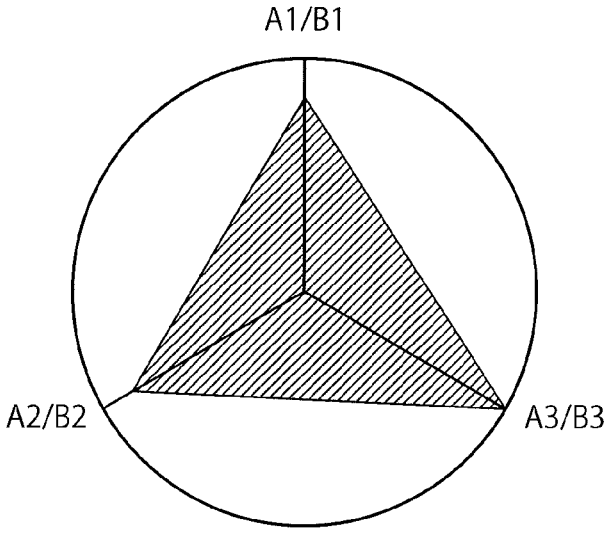
FIG. 6 is a diagram for explaining a determination method of measurement conditions.

As shown in FIG. 6, the controller 40 defines a polygon with the intensity ratios "A/B" taken as its vertices. For example, if the sample 100 contains three kinds of ion particles of carbon (C), nitrogen (N) and hydroxyl group (OH), the polygon is provided as a triangle. Then, the controller 40 calculates the area of the polygon (triangle in FIG. 6) every time the measurement conditions are adjusted. The detection sensitivity for the particles becomes higher as this area becomes larger. Therefore, in step S10, the controller 40 determines the measurement conditions under which the aforementioned area of the polygon is largest.

According to the present embodiment described above, in mass spectrometry of particles contained in the sample 100, the influence of gas particles is eliminated by mass spectrometry of the gas particles which are ionized in the non-irradiation mode of the ion beam 201. Moreover, the controller 40 automatically determines the measurement conditions suitable for detection of the particles contained in the sample 100 on the basis of the intensity ratios "A/B" in the irradiation mode and in the non-irradiation mode. Accordingly, detection accuracy of particles can be simply enhanced in a short time.

Second Embodiment

Hereafter, a second embodiment is described. In the present embodiment, the configuration of an apparatus according thereto is similar to that of the aforementioned mass spectrometry apparatus 1, and description thereof is omitted.

In the aforementioned mass spectrometry apparatus 1, the mass spectrometer 30 performs mass spectrometry on the basis of a time of flight "TOF" of an ion particle. Therefore, in detection of kinds of ion particles that are small in mass difference therebetween, such, for example, as a hydride ($^{30}$SiH) of a silicon isotope ($^{30}$Si) with mass number 30 and phosphorus (P), it is needed to enhance the resolution between the ion particles.

Figure 7:
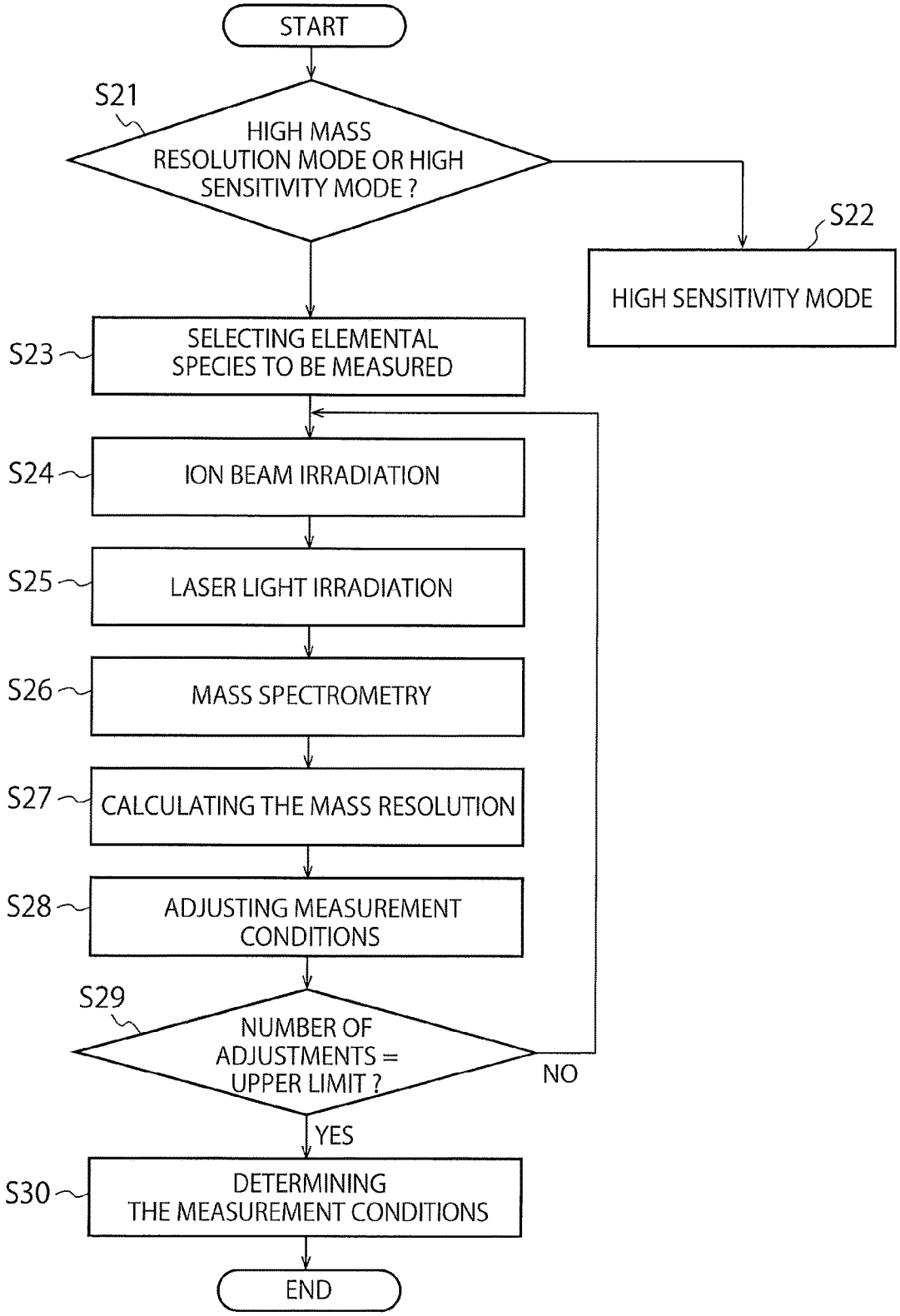
FIG. 7 is a flowchart showing a mass spectrometry method according to a second embodiment.

Hence, in the present embodiment, mass spectrometry is performed based on a flowchart shown in FIG. 7. FIG. 7 is a flowchart showing a mass spectrometry method according to the present embodiment.

First, user's operation selects a high mass resolution mode or a high sensitivity mode. The selection result is input to the controller 40 (step S21). When the high sensitivity mode is selected (step S22), the operations in step S1 to step S10 shown in FIG. 4 described for the first embodiment are performed.

When the high mass resolution mode is selected, user's operation selects elemental species to be measured. The selection result is input to the controller 40 (step S23). Subsequently, the beam irradiator 10 irradiates the sample 100 with the ion beam 201 on the basis of control of the controller 40 (step S24). Subsequently, the laser irradiator 20 irradiates the space above the sample 100 with the laser light 202 (step S25). Next, the mass spectrometer 30 performs mass spectrometry of ion particles (step S26). The analysis result of the mass spectrometer 30 is output to the controller 40.

The controller 40 calculates a mass resolution "r" between the ion particles corresponding to the elemental species which are selected in step S23, on the basis of the analysis result of the mass spectrometer 30 (step S27). Herein, the mass resolution "r" is described with reference to FIG. 8A and FIG. 8B.

Figure 8A:
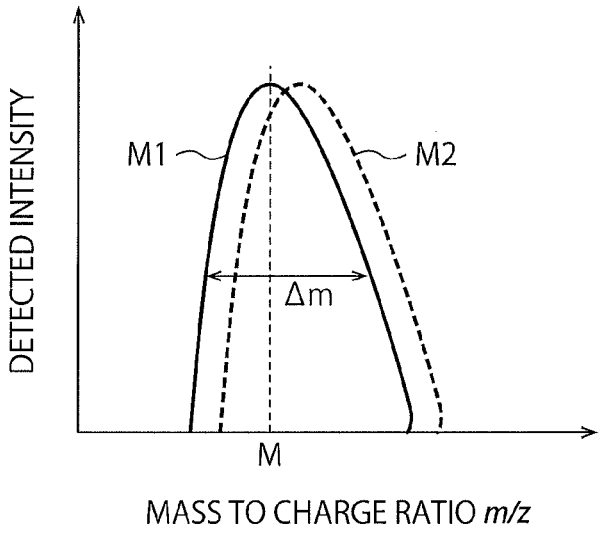
FIG. 8A exemplarily shows a mass spectrum with low mass resolution.
Figure 8B:
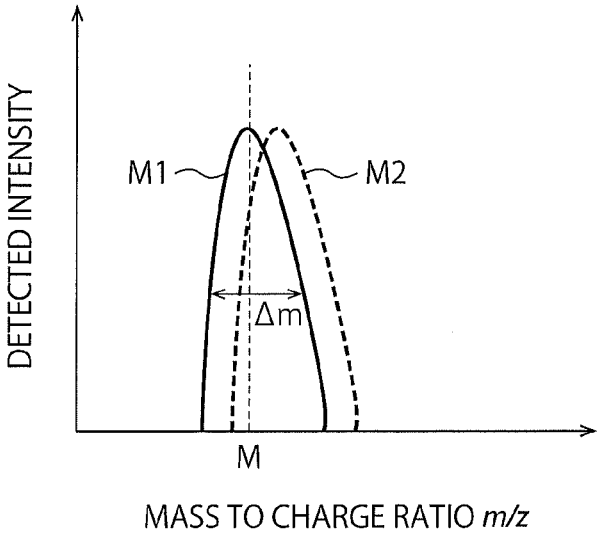
FIG. 8B exemplarily shows a mass spectrum with high mass resolution.

FIG. 8A exemplarily shows a mass spectrum with low mass resolution "r". Meanwhile, FIG. 8B exemplarily shows a mass spectrum with high mass resolution "r". In FIG. 8A and FIG. 8B, the horizontal axis designates a mass to charge ratio "m/z" between a mass "m" and a charge number "z", and the vertical axis designates detected intensities of ion particles M1 and M2 which are selected in step S23. Notably, the scales of the vertical axis and the horizontal axis in FIG. 8A are the same as the scales of the vertical axis and the horizontal axis in FIG. 8B.

The controller 40 calculates the mass resolution "r" on the basis of $r=M/\Delta m$, where "M" is a mass to charge ratio corresponding to the peak value of a detected intensity, and "Δm" is a so-called half-value width. Specifically, "Δm" is the half-value width of the peak value of the mass to charge ratio "M".

In FIG. 8A, the mass spectrum of the ion particles M1 and M2 overlap with each other, and the mass resolution "r" is low. Hence, in order to enhance the mass resolution "r" as shown in FIG. 8B, the controller 40 adjusts the measurement conditions for the ion particles M1 and M2 (step S28). In the present embodiment, the controller 40 controls the light source 21 of the laser irradiator 20 to change the delay time from the irradiation start time of the ion beam 201 to the irradiation start time of the laser light 202. Notably, similarly to the first embodiment, the controller 40 may change the position of the lens 22 or the applied voltages to the electrodes of the mass spectrometer 30.

The aforementioned operations in step S24 to step S28 are performed until the number of adjustments of the measurement conditions reaches a preset upper limit, in order to enhance the mass resolution "r" between the ion particles M1 and M2 (step S29). Similarly to the first embodiment, also in the present embodiment, by limiting the number of the control operations of the controller 40, a measurement time can be suppressed.

When the number of adjustments reaches the upper limit, the controller 40 determines the measurement conditions on the basis of the mass resolution "r" calculated every time the adjustments are performed (step S30). In the present embodiment, the controller 40 determines the measurement conditions under which the mass resolution "r" is highest.

According to the present embodiment described above, in mass spectrometry of kinds of ion particles small in mass difference therebetween, the measurement conditions are automatically determined such that the mass resolution "r" becomes high. Therefore, detection accuracy of the aforementioned ion particles can be simply enhanced in a short time.

Notably, in a mass spectrometry apparatus as defined in the accompanied claims, a controller may calculate an intensity ratio between a detected intensity of a particle in an irradiation mode and a detected intensity of the particle in a non-irradiation mode every time a control operation is performed, and determine a measurement condition of the particle on the basis of the intensity ratio.

Moreover, in the aforementioned mass spectrometry apparatus, the controller may calculate an area of a polygon with intensity ratios taken as its vertices every time a control operation is performed, and determine a measurement condition on the basis of the calculated area.

Moreover, in the aforementioned mass spectrometry apparatus, a priority of a control operation may be preset.

Moreover, in the aforementioned mass spectrometry apparatus, an upper limit of the number of control operations may be preset.

Moreover, in the aforementioned mass spectrometry apparatus, the controller may determine a measurement condition of a particle on the basis of a mass resolution.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A mass spectrometry apparatus comprising:

a beam irradiator to irradiate a sample with an ion beam;

a laser irradiator to irradiate a space above the sample with laser light;

a mass spectrometer to perform mass spectrometry of an ionized particle; and a controller to perform a control operation of controlling at least one of the laser irradiator and the mass spectrometer on the basis of at least one analysis result of the mass spectrometer, wherein the controller calculates a mass resolution between kinds of particles on the basis of the analysis result, and performs the control operation on the basis of the calculated mass resolution.

2. The mass spectrometry apparatus according to claim 1, wherein the mass spectrometer includes an electrode disposed along a trajectory of the particle, and the controller controls a voltage applied to the electrode by the control operation.

3. The mass spectrometry apparatus according to claim 1, wherein the laser irradiator includes a lens to condense the laser light, and the controller controls a position of the lens or a delay time from an irradiation start time of the ion beam to an irradiation start time of the laser light by the control operation.

4. A mass spectrometry apparatus comprising:

a beam irradiator to irradiate a sample with an ion beam;

a laser irradiator to irradiate a space above the sample with laser light;

a mass spectrometer to perform mass spectrometry of an ionized particle; and a controller to perform a control operation of controlling at least one of the laser irradiator and the mass spectrometer on the basis of at least one analysis result of the mass spectrometer, wherein the controller calculates at least one intensity ratio between a detected intensity of the particle in an irradiation mode of irradiation with the ion beam and a detected intensity of the particle in a non-irradiation mode of no irradiation with the ion beam every time the control operation is performed, and determines a measurement condition for the particle on the basis of the intensity ratio.

5. The mass spectrometry apparatus according to claim 4, wherein the controller calculates an area of a polygon with the intensity ratios taken as vertices of the polygon every time the control operation is performed, and determines the measurement condition on the basis of the calculated area.

6. The mass spectrometry apparatus according to claim 1, wherein a priority of the control operation is preset.

7. The mass spectrometry apparatus according to claim 1, wherein an upper limit of the number of times of the control operation is preset.

8. The mass spectrometry apparatus according to claim 1, wherein the controller determines a measurement condition for the particle on the basis of the mass resolution.

9. A mass spectrometry method comprising:

irradiating a sample with an ion beam;

irradiating a space above the sample with laser light;

performing mass spectrometry of a particle ionized with the laser light;

calculating a mass resolution between kinds of particles on the basis of an analysis result of the particle; and controlling at least one of an irradiation condition for the laser light and a mass spectrometry condition for the particle on the basis of the calculated mass resolution.

10. A mass spectrometry method comprising:

irradiating a sample with an ion beam;

irradiating a space above the sample with laser light;

performing mass spectrometry of a particle ionized with the laser light;

controlling at least one of an irradiation condition for the laser light and a mass spectrometry condition for the particle on the basis of an analysis result of the particle;

calculating at least one intensity ratio between a detected intensity of the particle in an irradiation mode of irradiation with the ion beam and a detected intensity of the particle in a non-irradiation mode of no irradiation with the ion beam every time the controlling steps is performed; and determining a measurement condition for the particle on the basis of the intensity ratio.

* * * * *